United States Patent [19]

Beckley

[11] Patent Number: 4,522,384

[45] Date of Patent: Jun. 11, 1985

[54] MACHINE FOR COLLATING SIGNATURES IN THE SADDLE FORMAT

[75] Inventor: Robert A. Beckley, Mount Vernon, Ill.

[73] Assignee: World Color Press, Inc., Effingham, Ill.

[21] Appl. No.: 537,865

[22] Filed: Sep. 30, 1983

[51] Int. Cl.[3] ..... B65H 39/02

[52] U.S. Cl. ..... 270/54; 271/185; 198/408; 198/423; 198/612; 83/925 A

[58] Field of Search ..... 270/54, 58, 55; 198/407–416, 419, 431, 462, 579, 604–607, 610–612, 633, 423; 83/925 A; 271/184–186

[56] References Cited

U.S. PATENT DOCUMENTS

| | | | |
|---|---|---|---|
| 2,731,263 | 1/1956 | Baril, Jr. et al. | 271/285 |
| 3,913,467 | 10/1975 | Braband | 270/54 |
| 3,918,703 | 11/1975 | Mano et al. | 271/185 |
| 4,121,818 | 10/1978 | Riley et al. | 270/54 |
| 4,155,440 | 5/1979 | Bogdanski et al. | 271/185 |
| 4,198,039 | 4/1980 | Bryson et al. | 270/54 |
| 4,262,897 | 4/1981 | Kopacz | 271/185 |
| 4,275,873 | 6/1981 | Rathert | 270/54 |
| 4,330,116 | 5/1982 | Newsome | 271/185 |

FOREIGN PATENT DOCUMENTS

| | | | |
|---|---|---|---|
| 519942 | 11/1953 | Belgium | 271/185 |

*Primary Examiner*—E. H. Eickholt

*Attorney, Agent, or Firm*—Gravely, Lieder & Woodruff

[57] ABSTRACT

A machine for collating signatures has a pair of side-by-side gathering chains as well as feeding apparatus along the chains, with each feeding apparatus being adapted to open signatures and deposit them on the chain along that apparatus, so that the signatures accumulate on the chain in a saddle format. The compiled signatures are trimmed as they pass along the chain, and at the end of the chain they are discharged into a layup unit where they are turned from a vertical disposition to a horizontal disposition. The layup unit has at the end of each gathering chain a pair of high friction belts which come together at a nip into which the chains project the compiled signatures. The belts grip the compiled signatures near the folds in those signatures and move the depending portions of the signatures against and over a bar which deflects the depending portions laterally and into a horizontal disposition. The two sets of belts in the layup unit discharge the signatures onto a shingling conveyor in two rows, and on the shingling conveyor they overlap in a shingled condition. The shingling conveyor directs the shingled signatures into two stacking machines which arrange them in stacks that are conveniently removed and otherwise handled. The collating machine is very compact and requires a minimum of personnel to operate. Indeed, a single attendant may load the feeding apparatus for both gathering chains.

20 Claims, 7 Drawing Figures

MACHINE FOR COLLATING SIGNATURES IN THE SADDLE FORMAT

BACKGROUND OF THE INVENTION

This invention relates in general to collating and more particularly to a machine for collating signatures in a saddle format.

Many magazines and other publications of multiple pages are arranged in a saddle format, meaning that the individual signatures which form these publications are laid one within the other instead of one on top of the other as in a so-called perfect binding. The folds of all of the signatures lie along a common line, and several staples are usually driven through these folds to complete the saddle binding, although in small saddle bound publications, such as inserts for newspapers, the staples are often omitted.

The typical saddle binding machine has an endless gathering chain, the upper pass of which runs beneath a succession of feeding devices, each of which is capable of depositing a different signature onto the gathering chain. In particular, each feeding device contains a pocket in which the signatures as they are delivered from the printing press are stacked. Thus, the signatures rest one upon the other in the pocket of the feeding device. In addition, the feeding device has an apparatus for extracting signatures one at a time from the pocket, for opening each signature after it is extracted, and for releasing the signature at the proper instant so that it drops onto the chain with its folds along the upper edge of the chain and its pages draping downwardly to the sides of the chain. Thus, as the chain moves under the feeding devices it acquires more and more signatures, and upon emerging from the last feeding device it should have enough signatures compiled in the proper order to constitute the full publication. Thereafter, the chain discharges the compiled signatures onto a conveyor which extends laterally away from the gathering chain. Along this lateral conveyor a cover may be applied and staples are driven through the folds of the cover and compiled signatures to hold them together in a saddle binding. The cover and signatures are also trimmed along this conveyor so that their margins register. The conveyor stacks the publication upon discharge and the stacks are usually removed by hand from the collating machine.

A conventional saddle binding machine of the foregoing construction may contain 18 or more feeding devices. Such a machine is about 85 feet long and the lateral conveyor, along which the trimming and stapling occur, occupies about 28 feet. The entire machine therefore consumes a considerable amount of plant space. It also requires a relatively large number of individuals to operate it, for normally one attendant can load only about four pockets. Another individual is required to monitor the gathering chain to insure that each feeding device deposits a signature on it, and this individual usually attends to any disruptions or misfeeds. The machines are not only costly in terms of the labor required to operate them, but they are also quite expensive in their own right.

Small publications containing only a few signatures do not justify the large investment required for the typical saddle binding machine. Nevertheless, small publications are compiled on such machines, for want of any other type of machine to assemble them.

SUMMARY OF THE INVENTION

One of the principal objects of the present invention is to provide a collating machine for assembling signatures in a saddle format. Another object is to provide a collating machine of the type stated that is highly compact. A further object is to provide a collating machine that requires a minimum amount of labor to maintain it in efficient operation. An additional object is to provide a collating machine of the type stated that is simple in construction and highly reliable in operation.

DESCRIPTION OF THE DRAWINGS

In the accompanying drawings which form part of the specification and wherein like numerals and letters refer to like parts wherever they occur—

DETAILED DESCRIPTION

Figure 2:
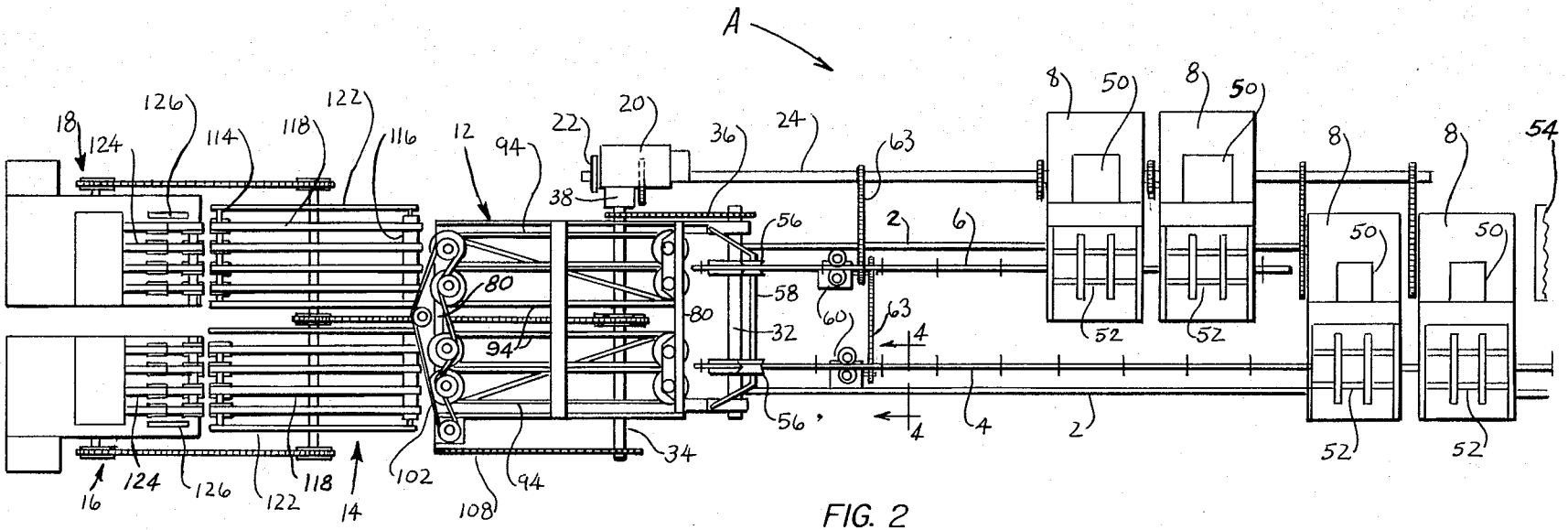
FIG. 2 is a plan view of the machine.
Figure 3:
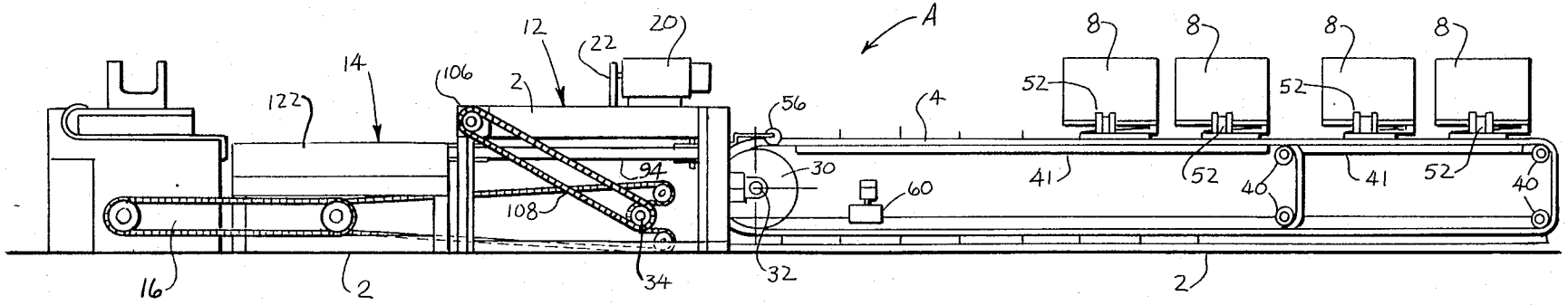
FIG. 3 is a side elevational view of the machine.

Referring now to the drawings, a collating machine A (FIGS. 1–3) compiles two or perhaps more signatures s in a saddle format so as to convert those signatures into a small publication. The signatures s are supplied to the machine A in stacks with each stack of course containing identical signatures arranged one on top of the other, their corresponding margins being in registration. Thus, the machine A accepts the signatures s in the manner in which they are delivered from a high speed printing press. After compiling the signatures s, that is arranging them in the proper order, the machine A likewise delivers the compiled signatures s in stacks. Several major components are embodied in the machine A, among them a frame 2, gathering chains 4 and 6 supported on the frame 2, feeding devices 8 located along the chains 4 and 6 for opening signatures s and depositing them on the chains 4 and 6 so that the signatures s accumulate or are compiled on the chains 4 and 6, a layup unit 12 for turning the compiled signatures s from a vertical disposition to a horizontal disposition, a shingling conveyor 14 onto which the layup unit 12 discharges the compiled signatures s in two rows, with the signatures s of each row overlapping, that is being in a shingled condition, and stacking machines 16 and 18 at the end of the shingling conveyor 10 for delivering the compiled signatures s in a stacked condition.

The frame 2 extends almost the entire length of the machine A and carries the two gathering chains 4 and 6 as well as feeding devices 8 for laying signatures s upon those chains. It likewise supports the layup unit 12 as well as the shingling conveyor 10, and the two stacking machines 16 and 18 are attached to it. In addition, the frame 2 supports an electric motor 20 (FIG. 2) which is coupled by means of a belt drive 22 to a main drive shaft 24 that extends substantially the full length of the frame 2, there being bearings along the frame 2 for supporting the shaft 24. The feeding devices 8, the layup unit 12, the shingling conveyor 14 and the stacking machines 16 and 18 are all connected to the main drive shaft 24 and derive the power for their operation from it. This further keeps the foregoing components synchronized. The two gathering chains 4 and 6 extend around large sprockets 30 at their ends that lead up to the layup unit 12, and these sprockets are mounted on a common cross shaft 32 (FIGS. 2 & 3) which is connected to another somewhat lower cross shaft 34 through a sprocket and chain drive 36. The other cross shaft 34, which extends beneath the layup unit 12, is coupled to the main drive shaft 24 through a right angle gear box 38. The opposite ends of the chains 4 and 6 pass around somewhat smaller sprockets 40 (FIG. 3), there being two at the other end of each chain 4 and 6 with one sprocket 40 being above the other. Moreover, the end sprockets 40 for the chain 4 are set ahead of the end sprockets 40 for the chain 6 so that the chain 4 is somewhat shorter than the chain 6. Indeed, the chain 4 passes around its end sprockets ahead of the two feeding devices 8 that deposit signatures s on the chain 6. Between its large sprocket 30 and the upper of its two end sprockets, the upper pass of each chain 4 and 6 rides on a slideway 41 (FIGS. 3 & 4) which is attached to the frame 2 and maintains the upper pass truly level.

The cross shaft 32 turns the large sprockets 30 such that the upper passes of the two chains 4 and 6 move from the feeding devices 8 to the layup unit 12, and therefore signatures s that are deposited on the upper passes by the feeding devices 8 are transported to the layup unit 12. To this end, the links of the chains 4 and 6 are fitted with crowns 42 (FIG. 4), there being a separate crown 42 on each link. Each crown 42 rises to a peak along the upper pass of its chain 4 or 6 so that signatures s which are deposited on the chains 4 and 6 will center over the chains with their folds along the aligned peaks of the crowns 42. At equal intervals the chains 4 and 6 are fitted with lugs 44 which project outwardly and upwardly without interferring or obstructing the aligned peaks of the crowns 42. The spacing between the lugs 44 is somewhat greater than the length of a signature s measured along its fold, and indeed the chain sections between the lugs 44 accommodate the signatures s, while the lugs 44 insure that successive signatures s remain separated and further push those signatures s off of the chains 4 and 6 and into the layup unit 12.

Figures 1, 4:
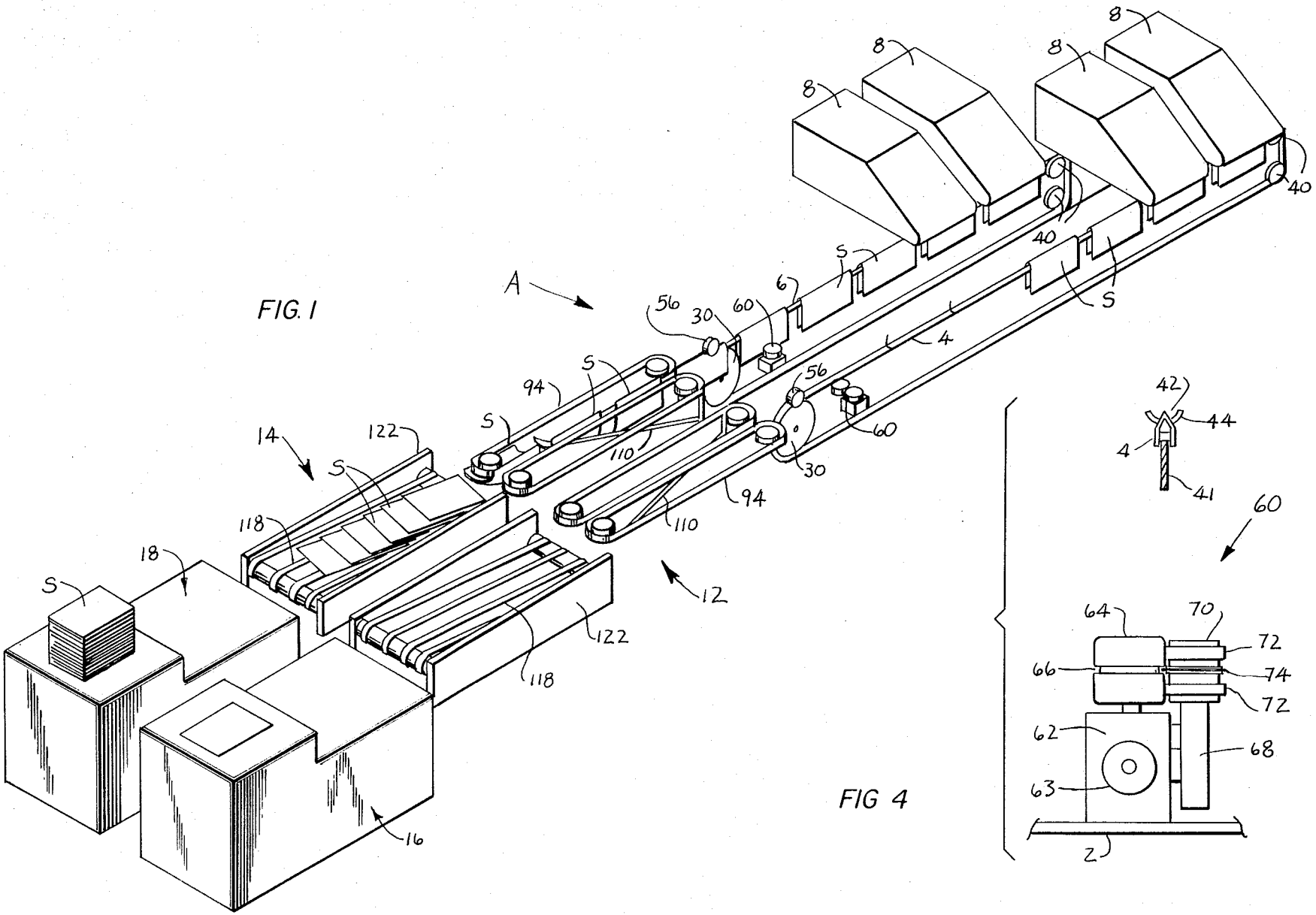
FIG. 1 is a schematic view of the collating machine in perspective and showing signatures transported along one of the two collating lines of the machine.
FIG. 4 is a sectional view of the machine taken along line 4—4 of FIG. 2 and showing one of the trimming units for the machine.

The feeding devices 8 are of the type used with conventional saddle collating and binding machines, and each is powered by the main drive shaft 24. Each includes a pocket 50 (FIG. 2) into which the signatures s as they are delivered from a press are stacked. The feeding device 8 also includes a mechanism 52 (FIGS. 2 & 3) for extracting the signatures one at a time from the pocket 50, opening each extracted signature s such that its fold is located directly above the upper pass of one of the chains 4 or 6 and then releasing the signature s so that it drops onto the chain 4 or 6 between two sets of lugs 44. The signature pages on each side of the fold drape downwardly along the sides of the upper pass, while the fold aligns with and rests on the peaks of the several crowns 42 for the section of the chain 4 or 6 on which the signature s comes to rest (FIG. 1). The mechanism 52 requires a vacuum to open the signatures s, and this vacuum is supplied by a vacuum pump 54 (FIG. 2) which is located beyond the first feeding device 8 and is powered by a separate motor. The feeding devices 8 are arranged in a row along the chains 4 and 6 with some of the devices 8 being positioned such that they deposit signatures s on the chain 4 and the rest being positioned such that they deposit their signatures s on the chain 6. Moreover, the feeding devices 8 for the chain 4 are located ahead of the devices 8 for the chain 6 and are offset slightly with respect to the devices 8 for the chain 6. Two or more feeding devices 8 may be located along each chain 4 and 6, and each deposits its signatures s in the spaces between successive lugs 44 on the upper pass of the chain 4 or 6 over which it is located. Thus, the first feeding device 8 along either chain 4 or 6 lays its signatures s directly onto the chain 4 or 6, whereas the next lays its signatures s over the signatures s placed on the chain 4 or 6 by the previous feeding device 8. Hence, the signatures s build up on each chain 4 or 6 as the chains 4 and 6 approach the layup unit 12. Since the feeding devices 8 for the chain 6 are located ahead of the feeding devices 8 for the chain 4, the signatures s are fully compiled on the chain 6 first and are transported in that condition past the feeding devices 8 for the chain 4 as signatures are compiled on the chain 4. The feeding devices 8, being conventional in construction, will not be described in any further detail.

Figure 5:
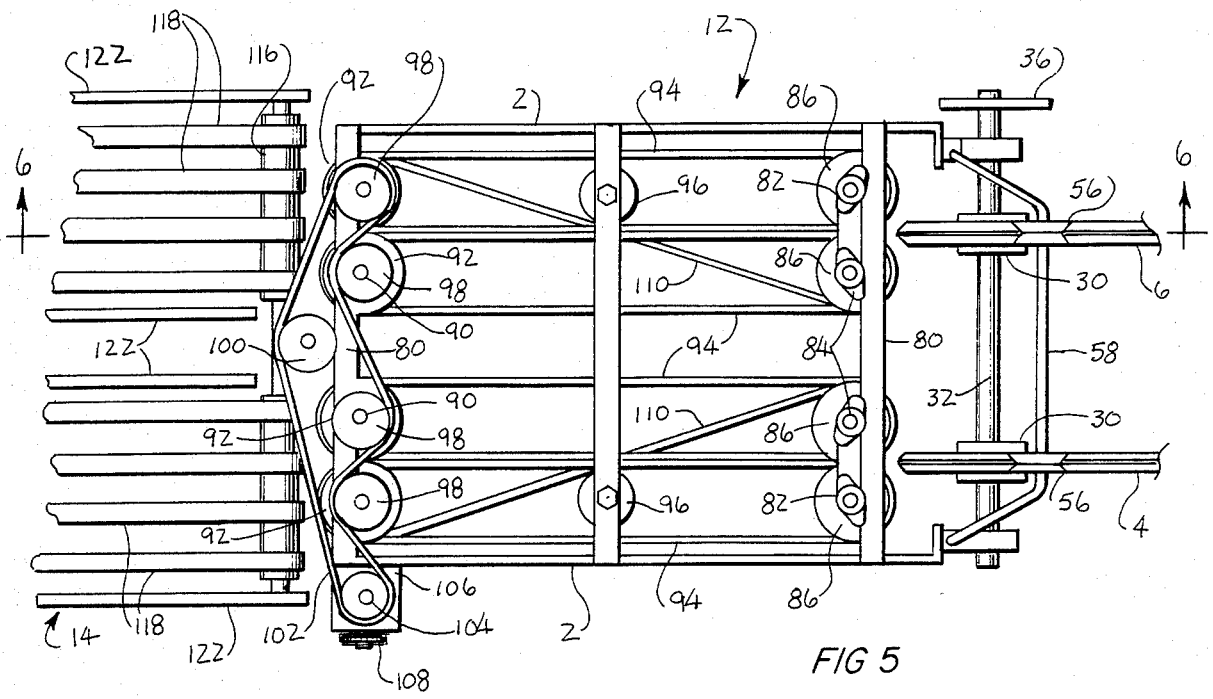
FIG. 5 is an enlarged plan view of the layup unit for the machine together with the adjacent portions of the gathering chains and shingling conveyor.
Figure 7:
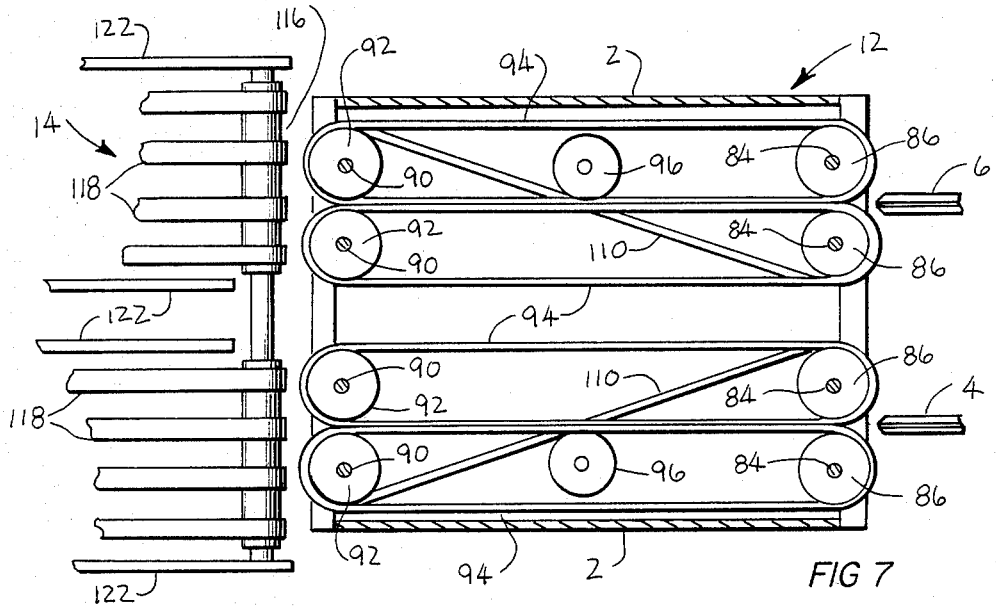
FIG. 7 is a sectional view of the layup unit taken along line 7—7 of FIG. 6 and showing the belts of the layup unit.

In order to prevent the signatures s from tipping downwardly as they pass over the large sprockets 30 at the ends of the chains 4 and 6, a small roller 56 (FIGS. 5 & 7) having a V-shaped groove rides the upper pass of each chain 4 and 6 just prior to the location where that upper pass turns downwardly over its sprocket 30. The rollers 56 revolve on a rod 58 that is attached to the frame 2, and their V-shaped grooves are configured to receive the peaks on the crowns 42 for the chains 4 and 6 as well as the folds of any signature s that may be over those crowns 42. Moreover, the rollers 56 are narrow enough to fit between the lugs 44 of each set. In this regard, the lugs 44 are arranged in pairs and project laterally from the chain 4 or 6 and then upwardly. Thus, as compiled signatures s pass over the sprockets 30 at the ends of the chains 4 and 6, the trailing ends of the compiled signatures s will be held against and supported on the chains 4 and 6, so the signatures s will project forwardly to be received by the layup unit 12. In other words, the rollers 56 prevent the signatures s from tipping downwardly at the ends of the gathering chains 4 and 6, and as a consequence the signatures s are projected forwardly beyond the ends of the chains 4 and 6 until they are gripped in the layup unit 12.

Mounted between the two passes of each gathering chain 4 and 6 is a trimming unit 60 (FIG. 4) which will, if set in operation, trim the lower margins of the compiled signatures s so that those margins register. Each trimming unit 5 includes a right angle gear box 62 that is connected to the main drive shaft 24 through a sprocket and chain drive 63. The output shaft of the gear box 62 projects upwardly and carries a drum 64 that rotates with a peripheral velocity that equals the velocity of the chains 4 and 6. Between its ends, the drum 64 contains a slit 66 which is positioned at the elevation at which a cut is to be made in the compiled signatures s as they pass by the drum 64. The gear box 62 also supports a bracket 68 which carries a free wheeling drum 70 that rotates about an axis that is parallel to the axis of the driven drum 64. Indeed, the free-wheeling drum 70 has rubber tires mounted upon it, and these tires 72 press against the driven drum 64, enabling the driven drum 64 to turn the free-wheeling drum 70. In addition, the free-wheeling drum 70 carries a circular knife 74 which projects into the slit 66 in the driven drum 64. Each trimming unit 60 is positioned on the frame 2 such that the nip between its driven and free wheeling drums 64 and 70 aligns with the compiled signatures s that are draped over the chain 4 or 6 along which the unit 60 is positioned. Thus, the pages depending from one side of the chain 4 or 6 pass between the two drums 64 and 70 where the circular knife 74 trims a narrow strip from each page of the compiled signatures s, thus bringing the lower margins of those pages into registration.

Figure 6:
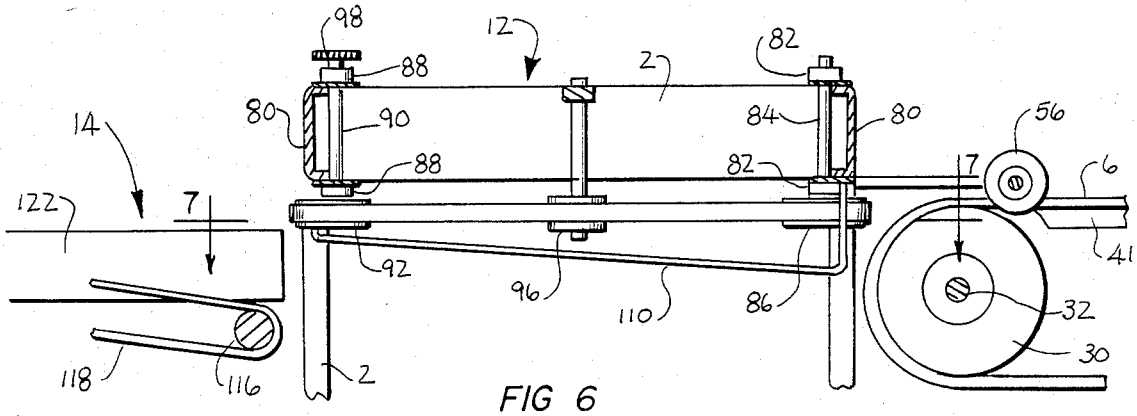
FIG. 6 is a sectional view of the layup unit taken along line 6—6 of FIG. 5.

The layup unit 12 (FIGS. 5–7) repositions the compiled signatures s, changing them from a vertical disposition to a horizontal disposition, and further discharges them onto the shingling conveyor 14 in a horizontal disposition. It includes front and rear cross members 80 that are bolted to the frame 2, one at each end of the unit 12. The rear cross members 80 support bearings 82 through which vertical shafts 84 extend, and each shaft 84 at its lower end carries a double groove idler pulley 86. The shafts 78 are arranged in pairs such that the pulleys 86 of each pair are next to each other and are located at about the elevation of the upper passes for the two gathering chains 4 and 6. Indeed, the space between the one pair of pulleys 86 aligns with the upper pass of the chain 4, while the space between the other pair aligns with the upper pass of the chain 6. The forward cross member 80 likewise supports bearings 88 through which vertical drive shafts 90 extend, and each of these shafts has a double groove drive pulley 92 at its lower end. The pulleys 92 are at the same elevation as the pulleys 86 and are likewise arranged in pairs such that each pulley 92 aligns a different pulley 86. Thus, the drive shafts 90 are spaced apart the same as the idler shafts 84.

Extended around each drive pulley 92 and the idler pulley 86 with which it aligns is a rubber belt 94 (FIGS. 5–7) having double ribs on its inside surface, with the ribs being arranged and configured to fit into the grooves of the pulleys 84 and 92. The outside surface of each belt, on the other hand is flat, and inasmuch as the belt 94 is formed from rubber, that surface possesses a relatively high coefficient of friction. Since the pulleys 86 and 92 at the ends of the belts 94 are arranged in pairs, the belts 94 are likewise arranged in pairs, and where the belts 94 of each pair come around the idler pulleys 84 their flat outside surfaces form a nip. These outside surfaces remain together all the way to the drive pulleys 92, thereby providing a means for gripping the compiled signatures s once they are discharged from the gathering chains 4 and 6. To insure that the adjacent passes of the belts 94 of each pair remain together beyond the nips at the idler pulleys 84, deflecting pulleys 96 are disposed between the passes of the two outermost belts 84, and these pulleys bear against the outside belts 94 of the two pairs such that the adjacent passes of each pair are deflected somewhat. The deflection is enough to insure that the adjacent passes of the belts 94 remain together between the idler and drive pulleys 86 and 92.

In contrast to the idler shafts 84, the drive shafts 90 have sprockets 98 (FIG. 5) fitted to their upper ends and extended around these sprockets as well as around an offset idler sprocket 100 is a roller chain 102. At one end of the front cross member 80 the chain 102 wraps around a drive sprocket 104 which is fitted to the output shaft of a gear box 106 that is attached to the frame 2. The input shaft to the gear box 106 is coupled by a sprocket and chain drive 108 to the lower cross shaft 34 which is in turn connected to the main drive shaft 24. The roller chain 102 passes along the drive sprockets 104 in a serpentine manner so that adjacent drive shafts 90 revolve in opposite directions. Moreover, the direction of rotation is such that the adjacent or contacting passes of each pair of belts 94 move away from the idler pulleys 86 and toward the drive pulleys 92. The velocity of the belts 94 is slightly greater than the velocity of the gathering chains 4 and 6.

As the compiled signatures s move off of the ends of the gathering chains 4 and 6 they project forwardly since the folds at their trailing ends are held against the chains 4 and 6 by the rollers 56 (FIG. 1). The chains 4 and 6 drive the compiled signatures s into the nips of the belts 94, whereupon the belts 94 grip the compiled signatures s along the adjacent flat surfaces of those belts 94 and withdraw those signatures s from the chains 4 and 6 at the large sprockets 30. The compiled signatures s remain compressed between the belts 94 and are carried by the belts 94 to the drive pulleys 92 at the opposite end of the layup unit 12.

The layup unit 12 further includes deflecting rods 110 (FIGS. 5–7) that extend beneath the pairs of gripping belts 94 and turn the depending portions of the compiled signatures s into a horizontal disposition, there being a separate deflecting rod 110 beneath each pair of gripping belts 94. In contrast to the belts 94 which are horizontal and parallel to the direction of advance for the compiled signatures s, the deflecting rods 110 are inclined and oblique to the direction of advance. In this regard, each rod 110 is supported on the cross members 80, and the end which is at the rear cross member 80 is lower than the end which is at the front cross member 80. Moreover, the end which is at the rear cross member is set inwardly from the adjacent passes of the pair of belts 94 with which that rod 110 is associated, while the end which is at the front cross member 80 is set outwardly adjacent passes of the pair of belts 94. Thus, the rod 110 extends obliquely with respect to the adjacent passes of the two belts 94. The depth of the rod 110 is such that the lower portions of the depending signatures s will come against it as those signatures s are conveyed by the belts 94 through the layup unit 12, and as those compiled signatures s advance the rod 110 deflects the depending portions of the signatures s both laterally and upwardly. When a compiled signature s reaches the region of the drive pulleys 92 for the belts 94 which convey it, its fold is still gripped in a vertical disposition, but its depending portion extends laterally and is supported in a horizontal disposition on the deflecting rod 110. To provide full support without obstructing the compiled signatures s, the front end of the deflecting rod is located laterally beyond trimmed margins of the compiled signatures s.

Thus, the signatures s enter the layup unit 12 in a vertical disposition, and it is in that condition that they are gripped near their folds and initially held by the gripping belts 94. However, as the compiled signatures s advance their depending portions are gradually deflected laterally toward the outside of the unit 12 and upwardly into a generally horizontal disposition. Once the signatures s are released from the grip of the belts 94, the region of the fold likewise assumes a horizontal disposition.

The layup unit 12 discharges the compiled signatures s in a horizontal disposition onto the shingling conveyor 14 (FIG. 2) which transports the compiled signatures s away from the layup unit in two rows and these rows are of course derived from the two pairs of belts 94 in the layup unit 12. The shingling conveyor 14 is likewise supported on the frame 2, and it includes head and tail rolls 114 and 116 and endless belts 118 which extend between the rolls 114 and 116. The tail rolls 116, which are adjacent to the discharge end of the layup unit 12, are located lower than the ends of the deflecting rods 110 so that the horizontally oriented signatures s, upon being discharged from the layup unit 12, will drop onto the endless belts 118 of the shingling conveyor 14.

The head roll 114 of the shingling conveyor 14 is connected by means of a sprocket and chain drive to the lower cross shaft 34 that is beneath the layup unit 12, and the speed ratio of this drive is such that the velocity of the belts 118 for the shingling conveyor 14 is somewhat less than the velocity of the rubber belts 94 for the layup unit 12. As a consequence, the compiled signatures s upon being deposited on the belts 118 of the shingling conveyor 14 overlap (FIG. 1), or in other words assume a shingled condition.

The belts 118 of the shingling conveyor 14 are arranged in two sets - one set for each row derived from the layup unit 12. Moreover, the belts 118 of each set are offset to the side toward which the deflecting rod 110 that precedes it extends, and this is of course the side toward which the deflecting rod 110 turns the compiled signatures s. The arrangement is such that the compiled signatures s, upon being discharged in a horizontal disposition from each set of belts 94 of the layup unit 12, are generally centered over that set of belts 118 of the shingling conveyor 14 onto which they are discharged.

The signatures s upon leaving the layup unit 12 tend to skew slightly by reason of the frictional resistance encountered along the deflecting rods 110. To keep these somewhat skewed signatures s reasonably aligned along the shingling conveyor 14, the shingling conveyor 118 is provided with guide plates 122 (FIGS. 5–7) that extend along both sides of each set of belts 118 so as to provide channels in which the compiled signatures s are confined. The spacing between the two plates 122 for each channel is somewhat wider than the width of the compiled signatures s in order to accommodate some skewing of the signatures s.

The stacking machine 16 aligns with one set of belts 118 and its channel on the shingling conveyor 14, while the stacking machine 18 aligns with the other set of belts 118 and its channel. The stacking machines 16 and 18 may be of the type used at the end of a press for stacking signatures as they are discharged from the press. A Stobb stacker is suitable, and this brand of stacking machine builds the stacks of signatures from beneath, or in other words additional signatures are added to the stack from the bottom.

Since the stacking machines 16 and 18 are conventional, they will not be described in detail other than to note that each is coupled to and driven by the main drive shaft 24, and that each has a belt conveyor 124 (FIG. 2) that receives compiled signatures s from the set of belts 118 with which the machine 16 or 18 aligns. Also, each has a jogging device 126 located along its belt conveyor for bringing the somewhat skewed signatures s that are deposited on it by belts 118 of the shingling conveyor 14 into alignment, and this insures that the compiled signatures s in the stacks that are produced will be in marginal registration. These stacks of compiled signatures s represent the product of the collating machine A and they are removed by hand for subsequent distribution or processing.

OPERATION

In order to produce the compiled signatures s from individual signatures s that are obtained from a printing press, the individual signatures s must be loaded into the pockets 50 of the feeding devices 8. The signatures s in the stack of each feeding device 8 are identical insofar as printed content and orientation are concerned, but will differ from the printed signatures s in the stacks of the other feeding devices 8, at least insofar as the printed content is concerned.

In any event, when the electric motor 20 for the collating machine A is energized, the gathering chains 4 and 6 move, causing the upper passes of those chains to move along their slideways 41 and thereby advance beneath the discharge ends of the feeding devices 8. Since the feeding devices 8 are connected to the motor 20 through the main drive shaft 24, they are likewise energized. The first feeding device 8 along the chain 4 extracts a signature s from the bottom of the stack in the pocket 50 for that device 8, opens that signature s, and drops it onto the chain 4 between two sets of lugs 44. The signature s is deposited such that the fold lines of its several pages are located directly above the chain 4, so that half of the pages are on one side of the chain 4 and the other half are on the other side of the chain 4 (FIG. 1). The chain 4 advances the signature s to the next feeding device 8 which extracts a signature s from its pocket 50, opens that signature s, and drops it onto the signature s previously deposited on the chain 4 by the preceding feeding device 8. Again, half of the pages of the subsequent signatures s are on one side of the chain 4, while the other half are on the other side of the chain 4, and the fold lines are located along the top of the chain 4 directly over the fold lines of the previously laid signature s. Indeed, the previously laid signature s is in a sense enveloped within signature s deposited by the subsequent feeding device 8. The feeding devices 8 along the other gathering chain 6 deposit signatures s on that chain in a similar manner so that both chains 4 and 6 beyond their respective feeding devices 8 carry compiled signatures s, that is compilations of the individual signatures s that were placed in the pockets 50 of the feeding devices 8 for those chains 4 and 6.

As the compiled signatures s approach the trimming units 60 located along their respective chains 4 and 6, thin strips are severed from the lower portions of the depending pages so that the bottom margins of the pages are in registration.

After being trimmed, the compiled signatures s pass under the narrow rollers 56 which hold the fold lines of the signatures s against the horizontal portions of the chains 4 and 6 as the chains 4 and 6 pass around the sprockets 30, so that the compiled signatures s are in effect projected beyond the sprockets 30 with their fold lines in a generally horizontal disposition (FIG. 1). Indeed, the chains 4 and 6 project the compiled signatures s into the nips formed by the converging rubber belts 94 of the layup unit 12. These belts, it will be recalled, are arranged in pairs with each pair forming a nip, the nip of one pair aligning with the chain 4 and the nip of the other pair aligning with the chain 6. The belts 94 grip the compiled signatures s and pull them off of their respective chains 4 and 6 and thereafter, at least initially, continue to advance the signatures with their pages depending downwardly, that is with the signatures s in a vertical disposition. However, as the compiled signatures s advance, their leading margins come against the deflecting rods 110 which turn the depending portions of the compiled signatures s laterally and into a horizontal disposition. By the time the compiled signatures s reach the discharge end of the layup unit 12, their formally depending portions are totally horizontal, while the portions in the regions of the folds are vertical, inasmuch as this is the region in which the signatures s remain in the grip of the belts 94.

The belts 94 drive the compiled signatures s out of the layup unit 12 and onto the belts 118 of the shingling conveyor 14 (FIG. 1). The belts 118, being offset somewhat from the belts 94 of the layup unit 12, align with the signatures s which for the most part are disposed to the sides of the belts 94 on the layup unit by reason of having been diverted by the deflecting rods 110. The belts 118 of the shingling conveyor 14 move at a slower velocity than the belts 94 of the layup unit and as a consequence the signatures s overlap on the shingling conveyor 14 or in other words assume a shingled condition. The shingling conveyor 14 transports the compiled signatures s in a shingled condition to the stacking machines 16 and 18, there being a separate row of shingled signatures s leading up to each machine 16 and 18.

The stacking machines 16 and 18 continue to advance the signatures s in a shingled condition and further jog them into marginal alignment. Each machine 16 and 18 thereafter arranges its compiled signatures s in stacks, and it is in this condition that the compiled signatures s are removed from the collating machine A for handling or further processing.

The collating machine A requires only one attendant for loading the pockets 50 of the four feeding machines 8 which together serve the two gathering chains 4 and 6. Moreover, it is highly compact and with all components arranged in a single line. It therefore does not consume an inordinate amount of floor space. Two collating machines A may be positioned next to each other with their chains 4 and 6 and the discharge ends of their feeding devices 8 presented toward each other. When so disposed a single operator working in the space between the two machines A can perform normal operating duties from a relatively small area. The machine A is easily constructed and inexpensive to manufacture.

This invention is intended to cover all changes and modifications of the example of the invention herein chosen for purposes of the disclosure which do not constitute departures from the spirit and scope of the invention.

What is claimed is:

1. A machine for collating signatures in a saddle format, said machine comprising: first and second endless gathering chains located side-by-side and parallel to each other and having feed and discharge ends, the first gathering chain being longer than the second gathering chain so that the feed end of the first chain is located beyond the feed end of the second chain; at least two feeding means located in succession along each gathering chain for depositing signatures on the chains such that the folds of the signatures are along the upper portions of the chains and the pages on each side of the folds drape downwardly along the sides of the chains, whereby that the signatures as they move along the chains are in a vertical position, the first feeding means in the succession along each chain depositing its signatures directly on the chain and each subsequent feeding means in the succession depositing its signatures on the signatures deposited by the feeding means immediately ahead of it in the succession, the feeding means for the first chain being located ahead of the feed end of the second gathering chain as well as ahead of the feeding means for the second chain; layup means located immediately beyond the discharge ends of the first and second gathering chains for turning the compiled signatures from a substantially vertical to a substantially horizontal position and for discharging the compiled signatures in first and second rows in a substantially horizontal position; a shingling conveyor located beyond the layup means for receiving the two rows of compiled signatures discharged from the layup means and for further arranging those compiled signatures in a shingled condition, likewise in first and second rows; and first and second stacking means for converting the first and second shingled rows of compiled signatures into stacks.

2. The machine according to claim 1 wherein the layup means comprises: a pair of first belts which come together at a nip that aligns with the discharge end of first gathering chain such that signatures discharged from the first chain pass into the nip and are gripped near their folds by the first belts, a pair of second belts which come together at a nip which aligns with the discharge end of the second gathering chain such that signatures discharged from the second chain pass into the nip and are gripped near their folds by the second belts, the belts being narrow enough so that substantial portions of the compiled signatures depend from them, and deflecting means located below the belts for deflecting the depending portions of the compiled signatures into a generally horizontal position.

3. The machine according to claim 2 wherein the deflecting means of the layup means form a deflecting surfaces that extend obliquely with respect to the direction that the belts advance the compiled signatures.

4. The machine according to claim 3 wherein the deflecting surfaces are spaced farther from the belts where the belts form the nip than where the belts discharge the compiled signatures.

5. The machine according to claim 4 wherein the deflecting means are rods that extend beneath the belts, there being a separate rod beneath each pair of belts.

6. The machine according to claim 1 and further comprising a motor, a drive shaft connected to the motor, the feed means, the gathering chains, the layup means, the shingling conveyor and the stacking means all being connected to the drive shaft so that they are powered by the motor.

7. The machine according to claim 1 and further comprising trimming means located along each gathering chain beyond the location of the last feeding means for that chain for trimming narrow strips from the depending pages of the compiled signatures, so as to bring the lower margins of the pages into registration.

8. The machine according to claim 7 wherein each trimming means includes first and second drums which rotate and have their cylindrical surfaces coming together at a location such that the lower edges of the compiled signatures on the chains align with that location, whereby the lower edges pass between the drums, the first drum containing a groove that opens out of its periphery, and the second drum having a circular knife that projects beyond the periphery of that drum and into the groove of the first drum.

9. The machine according to claim 8 wherein at least one of the drums is turned such that its peripheral velocity corresponds to the velocity of the gathering chain beneath which it is located.

10. In a machine for collating signatures in a saddle format and including a gathering chain onto which different signatures are deposited one upon the other so that the folds of the signatures are located along the top of the chain and the pages depend along the sides of the chain, whereby the compiled signatures that are carried on the chain are in a vertical position, a layup apparatus for changing the orientation of the signatures from a vertical position to a horizontal position, said layup device comprising: a pair of endless elements which come together at a nip located immediately beyond the discharge end of the gathering chain and having adjacent passes located side-by-side beyond the nip, the endless elements being narrow in comparison to the width of the signatures and the nip being aligned with the gathering chain such that the compiled signatures upon moving off of the chain pass into the nip where they are gripped in the region of their fold lines by the adjacent passes of the endless elements and are thereafter advanced by the endless elements initially with substantially free portions depending from the endless elements; and means for deflecting the free portions of the signatures into a substantially horizontal position.

11. The combination according to claim 10 wherein the deflecting means is a surface which is located beneath the endless elements.

12. The combination according to claim 11 wherein the surface is inclined with respect to the endless elements, the spacing between the surface and the endless elements becoming progressively less in the direction of advance for the signatures along the layup apparatus.

13. The combination according to claim 12 wherein the surface extends generally obliquely with respect to adjacent passes of the endless elements so that the free portions of the compiled signatures upon contacting the surface are deflected laterally.

14. The combination according to claim 13 wherein the endless elements are belts having relatively high friction surfaces.

15. The combination according to claim 14 and further comprising adjacent first pulleys around which the belts pass to form the nip and adjacent second pulleys around which the belts pass at the ends of the adjacent passes, the first and second pulleys revolving about parallel axes that are upright.

16. The combination according to claim 15 and further comprising means located between the first and second pulleys for distorting one of the adjacent passes into the other of the adjacent passes so the adjacent passes remain together and will grip the compiled signatures between the first and second pulleys.

17. The combination according to claim 16 and further comprising a conveyor located beyond and leading away from the location at which the belts discharge the signatures, the conveyor being positioned such that the belts deposit the signatures on the conveyor and the conveyor operating at a speed less than the belts so that the signatures overlap in a shingled condition on the conveyor.

18. A machine for changing the orientation of signatures or other folded sheets, said machine comprising: an endless conveying device having a moving upper pass onto which the signatures are deposited one after the other with the folds of the signatures being located along the upper pass of the device and the pages depending along the sides of that pass, whereby the signatures are carried in a vertical position and eventually pass off the endless conveying device; a pair of endless belts having side-by-side passes which come together in the region where the signatures pass off of the endless conveying device and which separate remote from that region, the side-by-side passes in the region where they come together generally aligning with the upper pass of the endless conveying device such that the signatures upon leaving the endless conveying device come between the side-by-side passes of the belts and are gripped by the side-by-side passes in the region of their folds, the belts being powered such that their side-by-side passes move away from the endless conveying device so as to convey the signatures which are so gripped away from the endless conveying device, the belts being substantially narrower than the signatures are wide so that the signatures that are gripped by the side-by-side passes of the belts initially depend from the side-by-side passes; a deflecting surface positioned below the side-by-side passes to deflect the depending portions of the signatures laterally as the side-by-side passes advance the signatures, the deflecting surface extending to substantially the region at which the side-by-side passes separate, so that when the side-by-side passes release the signatures, the signatures are oriented generally horizontally; and means for receiving the generally horizontal signatures discharged from the side-by-side passes of the belts.

19. The machine according to claim 18 wherein means for receiving the generally horizontal signatures is a conveyor that moves away from the region at which the side-by-side passes of the belts separate.

20. The machine according to claim 18 wherein an endless conveying device is a gathering chain which passes over a sprocket that revolves about a generally horizontal axis located perpendicular to the direction in which the signatures advance along the chain; and further comprising means for urging the signatures at their fold lines against the gathering chain in the region of the sprocket so that the signatures in the region of the sprocket project beyond the chain and sprocket and into the region where side-by-side passes of the endless belts come together, whereby the signatures are gripped by the side-by-side passes of the two belts.

* * * * *